US005094634A

United States Patent [19]

Dixon et al.

[11] Patent Number: 5,094,634

[45] Date of Patent: Mar. 10, 1992

[54] ELECTRICAL CONNECTOR EMPLOYING TERMINAL PINS

[75] Inventors: Daniel A. Dixon; Hsin Lee; John E. Lopata, all of Naperville, Ill.

[73] Assignee: Molex Incorporated, Lisle, Ill.

[21] Appl. No.: 684,532

[22] Filed: Apr. 11, 1991

[51] Int. Cl.[5] ..... H01R 13/40

[52] U.S. Cl. ..... 431/751; 439/985

[58] Field of Search ..... 439/751, 885, 733, 722

[56] References Cited

U.S. PATENT DOCUMENTS

| | | | |
|---|---|---|---|
| 3,761,871 | 9/1973 | Teurgings | 439/751 |
| 3,769,686 | 11/1973 | Massey | 413/4 |
| 4,056,300 | 11/1977 | Schumacher | 339/103 R |
| 4,365,398 | 12/1982 | Chisholm | 29/845 |
| 4,717,354 | 1/1988 | McCleery | 439/733 X |
| 4,758,704 | 7/1988 | Kogel | 219/121.64 |
| 4,898,539 | 2/1990 | Glover et al. | 439/733 X |

FOREIGN PATENT DOCUMENTS

| | | | |
|---|---|---|---|
| 2038559 | 4/1971 | Fed. Rep. of Germany | 439/751 |
| 62-163279 | 7/1987 | Japan . | |
| 0194885 | 8/1988 | Japan | 219/121.64 |
| 0208564 | 1/1987 | United Kingdom | 219/121.64 |
| 2024539 | 1/1998 | United Kingdom | 439/751 |

*Primary Examiner*—Eugene F. Desmond

*Attorney, Agent, or Firm*—Charles S. Cohen; Stephen Z. Weiss

[57] ABSTRACT

An electrical connector includes a housing having at least one through hole. A terminal pin is inserted into the through hole and includes an enlarged retention portion and an enlarged stabilizing portion spaced longitudinally of the pin from the enlarged retention portion. Both the retention portion and the stabilizing portion are located in the through hole and at least the enlarged retention portion is sized to establish an interference fit with the housing within the hole. The enlarged retention portion is located adjacent a mid-point of the through hole, and the enlarged stabilizing portion is located adjacent one end of the through hole.

11 Claims, 2 Drawing Sheets

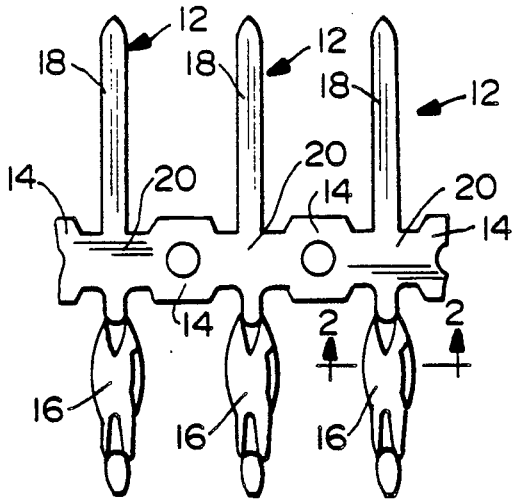
FIG.1
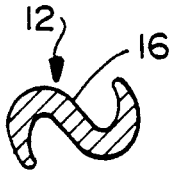
FIG.2
FIG.3
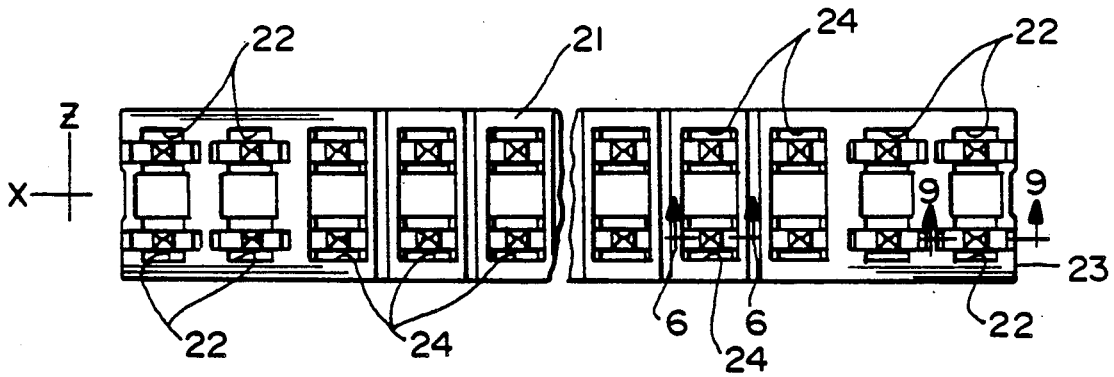
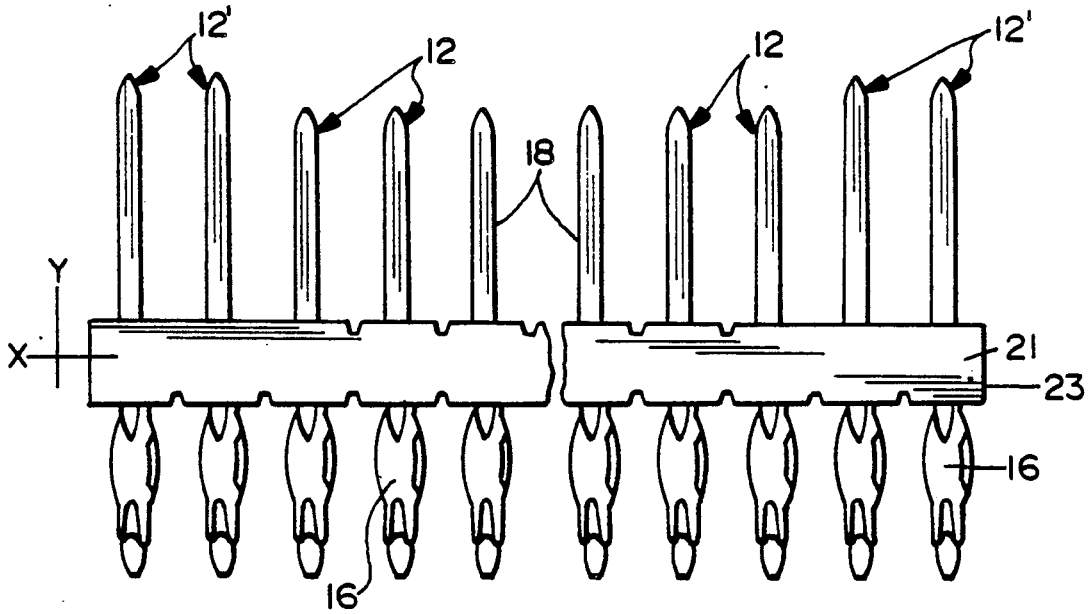
FIG.4

ELECTRICAL CONNECTOR EMPLOYING TERMINAL PINS

FIELD OF THE INVENTION

This invention generally relates to the art of electrical connectors and, particularly, to an electrical connector employing terminal pins in a support structure, such as a housing, header, wafer or the like.

BACKGROUND OF THE INVENTION

In the manufacture of many electronic apparatus it is conventional to employ elongated terminal pins formed with insertion ends which are inserted into through holes in a support structure to establish electrical connections with circuit traces of a printed circuit board or with female terminals of other electronic connection devices. It is important that the terminal pins maintain their structural integrity and positional relationship with the support structure in which they are inserted.

It also is conventional, in electrical connectors of the character described above, that the terminal pins be press fit into the support structure. Various problems are encountered with such manufacturing techniques. For instance, the support structure or header of such electrical connectors are elongated, and the length of the connectors often is limited because the structure tends to expand longitudinally or bow when the pressure fitted terminals are inserted thereinto. This may destroy the mating fit of the connector with a mating connector, a printed circuit board or the like.

In addition, during assembly and handling, the positional relationship of the end-most terminal pins of an elongated multi-terminal connector often are displaced relative to the support structure, again destroying the mating fit with a mating part. Due to the miniaturization of electrical components, stabilization of the pins in the support structure can be relatively difficult to achieve.

This invention is directed to solving the above problems by providing improved means for retaining and stabilizing terminal pins in electrical connectors of the character described.

SUMMARY OF THE INVENTION

An object, therefore, of the invention is to provide a new and improved electrical connector employing terminal pins and in which the pins are retained and stabilized in a support structure.

In the exemplary embodiment of the invention, generally, an electrical connector is provided with a housing having a plurality of through holes. A terminal pin is inserted into each through hole and includes an enlarged retention portion and an enlarged stabilizing portion spaced longitudinally of the pin from the retention portion. Both the retention portion and the stabilizing portion are located in the through hole of the housing, and at least the enlarged retention portion is sized to establish an interference fit with the housing within the hole. If desired, the stabilizing portion may also establish an interference fit with the through hole at spaced points within the hole.

In the preferred embodiment of the invention, the enlarged stabilizing portion of the terminal pin is located adjacent one end of the through hole, preferably the insertion end of the hole. The enlarged retention portion is located adjacent a mid-point of the through hole. Therefore, even though the housing has a tendency to expand in response to the forces created by the press fit of the terminal in the through hole, particularly in an elongated connector employing a large number of terminal pins, the central location of the retention portion in the through hole prevents bowing of the housing. The stabilization portion does not contact the housing in an interference fit along an axis parallel to that of the housing and therefore does not cause any bowing.

Each terminal pin is stamped and formed from sheet metal material. The enlarged retention and stabilizing portions are stamped portions of the pin, and the pin includes an enlarged formed compliant tail portion insertable through the hole in the housing. The hole is larger than the tail portion and includes slot means extending longitudinally thereof for receiving the enlarged retention and stabilizing portions of the pin and within which the portions establish interference fits. The width of the slot means is approximately the width of the stamped retention and stabilizing portions.

A feature contemplated by the invention is to form the enlarged stabilizing portions of the end-most pins in a multi-pin connector wider than the retention portions of the pins. The through holes for the end-most pins include recess means adjacent the insertion ends thereof for receiving the enlarged stabilizing portions. This provides additional stabilization for the end-most pins which are more prone to be engaged by foreign objects or surfaces during handling and assembly of the connector or which may be longer than the majority of the pins so as to mate first and are thus more prone to damage.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a fragmented elevational view of a terminal pin strip illustrating how the terminal pins are stamped and formed from she t metal material;

FIG. 2 is an enlarged section taken generally along line 2—2 of FIG. 1;

FIG. 3 is a fragmented top plan view of the housing or header into which the terminal pins are inserted;

FIG. 4 is a fragmented side elevational view of the header, with the terminal pins inserted thereinto;

DETAILED DESCRIPTION OF THE PREFERRED EMBODIMENT

Figure 5:
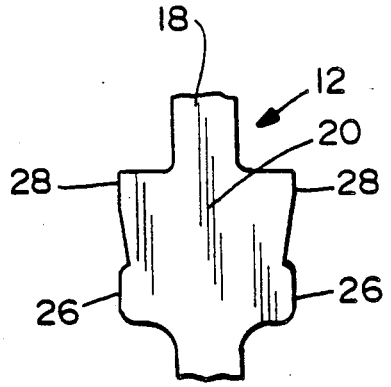
FIG. 5 is a fragmented elevational view of the center section of one of the center pins which is disposed within a respective through hole in the header.

Referring to the drawings in greater detail, and first to FIG. 1, the invention is directed to an electrical connector Which employs a plurality of terminal pins, generally designated 12. The terminal pins are shown in FIG. 1 still interconnected by web portions 14 as the pins are mass produced in a strip configuration by stamping and forming techniques from sheet metal material. The web portions are shaded to facilitate the illustration. Eventually, the web portions are severed to separate the terminal pins before the pins are inserted into the connector, as described hereinafter.

Each terminal pin 12 includes a tail portion 16 and a terminal portion 18, with an enlarged retention and stabilizing center section 20 therebetween. As will be described hereinafter, retention and stabilizing center section 20 is located in a through hole of a housing or header of the connector.

Referring to FIG. 2, tail portion 16 of each terminal pin 12 is generally S-shaped so that the tail portion is compliant for insertion into a hole in a printed circuit board, for instance. Terminal portion 18 is straight and is provided with a smooth finished surface for reception in an appropriate connector device (not shown).

FIG. 3 shows a support structure in the form of a housing or header 21 into Which terminal pins 12 are inserted, as seen in FIG. 4. The header is fabricated as a unitary component of dielectric material, such as molded plastic or the like. The header has a plurality of through holes into which the terminal pins are inserted. More particularly, FIG. 3 is a top plan view of the header, and it can be seen that two rows of holes are formed therethrough. The rows are parallel to the "x" axis while the holes are parallel to the "y" axis as shown in FIGS. 3 and 4. Each row has two end-most through holes 22 of one configuration, and the remaining through holes 24 between end-most holes 22 are of a somewhat different configuration, as described hereinafter. The pins are inserted into the header from the top along axes parallel to the "y" axis of FIG. 4.

FIG. 4 shows all of the through holes filled with terminal pins 12, with a pair of end-most terminal pins 12' at each opposite end of each row being slightly longer than the other terminal pins 12. The terminal pins 12' are longer than terminal pins 12 because the longer pins may be used to make ground and/or voltage connections. In this manner, the longer pins will establish ground and/or voltage connections prior to connecting the signal lines.

FIG. 5 shows center section 20 of one of the terminal pins 12 in greater detail. Each center section includes an enlarged retention portion defined by outwardly directed, stamped retention projections 26 and an enlarged stabilizing portion defined by outwardly directed, stamped stabilizing projections 28.

Figure 6:
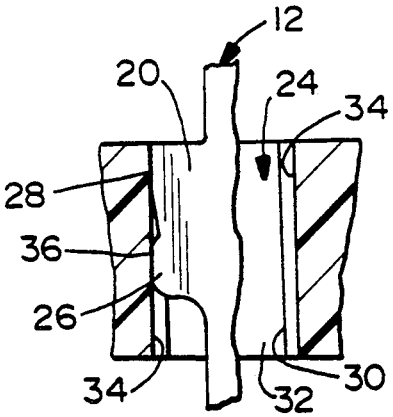
FIG. 6 is a fragmented vertical section, on an enlarged scale, taken generally along line 6—6 of FIG. 3, illustrating the configuration of a through hole for the center pins of the connector.
Figure 7:
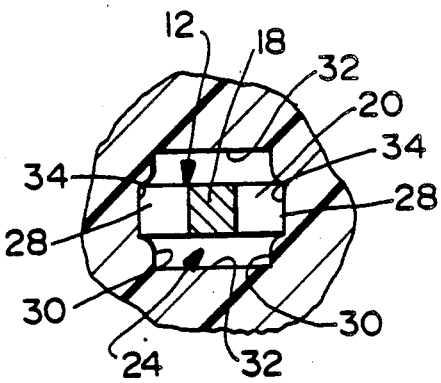
FIG. 7 is a fragmented top plan view, looking downwardly into the through hole of FIG. 6.

FIGS. 6 and 7 show the configuration of through holes 24 in header 21 for receiving terminal pins 12. Specifically, each through hole 24 is generally rectangularly shaped and includes opposite side walls 30 and opposite side walls 32. The side walls are spaced to define a through hole slightly larger than compliant tail portion 16 of one of the terminal pins 12. Side walls 30 are provided with longitudinal slots 34 into which retention projections 26 and stabilizing projections 28 protrude upon insertion of the terminal pin into the through hole.

It can be seen in FIG. 6 that stabilizing projections 28 are located adjacent the insertion end of the through hole, and retention projections 26 are located adjacent a mid-point, as at 36, of the through hole. Retention projections 26 are configured and sized to project outwardly from the terminal pins sufficiently to form an interference fit with the slots 34. Stabilizing projections 28 also are sized to form an interference fit at the top portion thereof with slots 34. Because only a small section of material at stabilizing projection 28 actually contacts slots 34, any bowing effect caused by the interference fit is not that large.

With the structure of center section 20 of terminal pin 12 and the configuration and size of through hole 24 and slot 34, it can be understood that, when viewing FIG. 6 in particular, a two-point engagement is established between the terminal pin and the through hole adjacent the insertion end of the hole and adjacent the mid-point of the hole to minimize the terminal pin from "rocking" along either the "x" or "z" axis of header 21 (FIG. 3).

Because of the need to miniaturize electronic components, the heights of pins 12 and 12' must be minimized. One method of achieving such a goal is for a portion of the S-shaped tail portion 16 to extend into the lower portion of cavities 22 and 24. Thus, stabilization means located at the bottom of the cavities is prevented or made extremely difficult. The retention projections 26 are located adjacent the mid-point of the through holes and the forces created by the press fit tend to expand the header but do not cause any bowing of the header. The stabilizing projections 28 located at the top of the cavities 22 and 24 will cause some, though minimal, bowing. In some designs, any bowing may be unacceptable thus preventing any interference fit of the stabilizing projections along the "x" axis. The design shown in FIG. 8 eliminates the interference fit of the stabilizing projections 28'.

Figure 8:
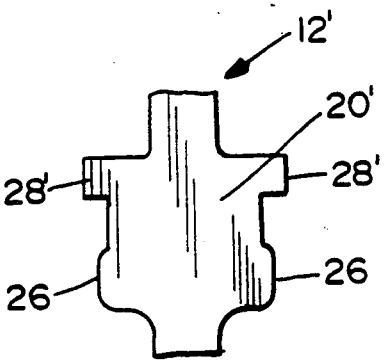
FIG. 8 is a fragmented elevational view of the center section of a terminal pin at the end of the header.

FIG. 8 shows the configuration of center section 20' of the two end-most terminal pins 12' shown in FIG. 4, in conjunction with through holes 22 shown in FIG. 3. Specifically, center section 20' is identical to center section 20 of each pin 12, except that stabilizing projections 28' protrude outwardly from the terminal pin a further extent than stabilizing projections 28 (FIG. 5) of terminal pin 12. When combined with a different structure of hole 22, this provides a greater degree of stability for the end-most terminal pins 12' which are more prone to come into contact with foreign objects or surfaces during handling or assembly. However, it should be understood that all of the terminal pins of the connector could be configured with center sections 20' and stabilizing projections 28', with corresponding enlarged recesses 40 in slots 34 as described below in relation to FIGS. 9 and 10.

Figure 9:
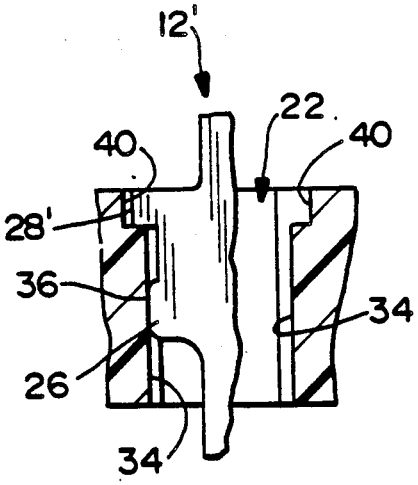
FIG. 9 is a fragmented vertical section, on an enlarged scale, taken generally along line 9—9 of FIG. 3.
Figure 10:
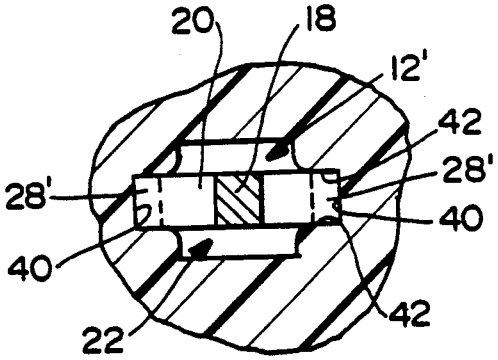
FIG. 10 is a fragmented top plan view, looking downwardly into the through hole of FIG. 9.

FIGS. 9 and 10 show the configuration of through holes 22 in header 21 for receiving terminal pins 12' (FIG. 8). Again, the through holes 22 are substantially identical to through holes 24, except that enlarged recesses 40 are formed at the insertion end of each through hole in communication with each slot 34. This recess accommodates the longer stabilizing projections 28'. The stabilizing projections 28' and recesses 40 are dimensioned so that there is no interference fit along the "x" axis. As a result, projections 28' cause no bowing of the header 21. Additional stability is provided along the "z" axis because the projections 28' contact the side walls 42 of recesses 40 in order to resist any rocking of the pins.

In order to maintain the consistency of the spacing between the endmost pins of two adjacent headers 21 and the pins within any header without omitting any pins, the thickness of the material of the header at the ends 23 of the headers is approximately half the thickness of the material between pins 12' of a header. Therefore, the amount of force exerted on the header by the interference fit of the endmost pins is limited. As a result, the stabilization provided by stabilizing projections 28 is especially useful with the endmost pins.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a housing having a through hole with a substantially uniform cross-section and recess means located adjacent said through hole; and a terminal pin inserted into the through hole and including a terminal portion, a tail portion and a housing engaging portion, said housing engaging portion having a retention portion and an enlarged stabilizing portion spaced longitudinally of the pin from the retention portion, the retention portion being located in the through hole and the stabilizing portion being located in the recess means, the retention portion being sized to establish an interference fit with the housing within the mid-section of the through hole, and the enlarged stabilizing portion being dimensioned wider than said retention portion and at least as narrow as said recess means.

2. The electrical connector of claim 1 wherein said enlarged stabilizing portion is located adjacent one end of the through hole and the terminal portion extends longitudinally from said stabilizing portion.

3. The electrical connector of claim 2 wherein the terminal is inserted into the through hole from one end thereof tail portion first, and said enlarged stabilizing portion is located at that one end.

4. The electrical connector of claim 1 wherein said through hole has cross dimensions for freely receiving the tail portion of the pin therein and wherein said recess means extend longitudinally thereof for receiving said stabilizing portion to prevent rocking of said pin.

5. The electrical connector of claim 4 wherein said terminal pin comprises a member which is stamped and formed from sheet metal material, said retention and stabilizing portions comprising stamped portions of the pin and including an enlarged formed tail portion of the pin, said tail portion being inserted first through the hole, the cross dimensions of the through hole being larger than the cross dimensions of the tail portion, and the width of the recess means being approximately the width of the stamped retention and stabilizing portions.

6. An electrical connector, comprising:

a housing having a through hole extending longitudinally thereof and recess means enlarging the through hole at one end thereof and a slot means extending longitudinally through the remainder of the hole; and a terminal pin sized for free insertion into the through hole and including an enlarged retention portion located in the slot means and sized to establish an interference fit with the housing within said slot means in the mid-section of the through hole, the terminal pin further including an enlarged stabilizing portion located in the through hole spaced longitudinally of the pin from the enlarged retention portion and sized to be received within said recess means to stabilize said pin.

7. The electrical connector of claim 6 wherein said recess means is wider than said enlarged stabilizing portion and both are located at a pin insertion end of the through hole.

8. The electrical connector of claim 6 wherein the terminal is inserted into the through hole from one end thereof, and said enlarged stabilizing portion is located at that one end.

9. The electrical connector of claim 6 wherein said terminal pin comprises a member which is stamped and formed from sheet metal material, said enlarged retention and stabilizing portions comprising stamped portions of the pin, and said pin terminal further including an enlarged formed tail portion of the pin insertable through the hole, the cross dimensions of the through hole being larger than the tail portion, the width of the slot means being approximately the width of the stamped retention portion and the width of the recess means being wider than the width of the stamped stabilizing portion.

10. An electrical connector, comprising:

an elongated housing having a plurality of spaced through holes in a row thereof lengthwise of the housing and including an end-most through hole at each opposite end of the row, and the end-most through holes including an outer wall perpendicular to said lengthwise direction, said outer wall being no thicker than approximately half the distance between adjacent edges of adjacent through holes, said end-most through holes further including recess means at insertion ends thereof enlarging the respective through holes and creating a shoulder therein; and a plurality of terminal pins inserted into the through holes and each pin including a retention portion located in its respective through hole and sized to establish an interference fit with the housing in the mid-section of the holes, end-most terminal pins in said row being located in said end-most through holes and further including an enlarged stabilizing portion spaced longitudinally of the respective pin from the retention portion thereof and sized to be received within said recess means and to engage said shoulder to minimize rocking of the pin.

11. The electrical connector of claim 10 wherein said recess means is at least as wide as said enlarged stabilizing portion.

* * * * *